US010760340B2

(12) United States Patent
von Gynz-Rekowski et al.

(10) Patent No.: US 10,760,340 B2
(45) **Date of Patent: *Sep. 1, 2020**

(54) UP DRILL APPARATUS AND METHOD

(71) Applicant: ASHMIN HOLDING LLC, Conroe, TX (US)

(72) Inventors: Gunther H H von Gynz-Rekowski, Montgomery, TX (US); Michael V. Williams, Montgomery, TX (US); Russell Koenig, Conroe, TX (US); Chaitanya P. Challa, Conroe, TX (US); Frank R. Vignal, Kingwood, TX (US)

(73) Assignee: Ashmin Holding LLC, Conroe, TX (US)

( * ) Notice: Subject to any disclaimer, the term of this patent is extended or adjusted under 35 U.S.C. 154(b) by 79 days.

This patent is subject to a terminal disclaimer.

(21) Appl. No.: 15/919,398

(22) Filed: Mar. 13, 2018

(65) Prior Publication Data

US 2018/0252040 A1 Sep. 6, 2018

Related U.S. Application Data

(63) Continuation of application No. 14/863,760, filed on Sep. 24, 2015, now Pat. No. 9,976,350.
(Continued)

(51) Int. Cl.
*E21B 6/02* (2006.01)
*E21B 4/10* (2006.01)
(Continued)

(52) U.S. Cl.
CPC ..... *E21B 6/02* (2013.01); *E21B 3/00* (2013.01); *E21B 4/10* (2013.01); *E21B 17/07* (2013.01)

(58) Field of Classification Search
CPC ..... E21B 6/02; E21B 4/10
(Continued)

(56) References Cited

U.S. PATENT DOCUMENTS 2,401,794 A 6/1946 Pratt
2,613,917 A 10/1952 Postelwaite
(Continued)

FOREIGN PATENT DOCUMENTS

CA 2664556 4/2008
EP 0432786 6/1991

OTHER PUBLICATIONS

Parent U.S. Appl. No. 14/863,760, filed Sep. 24, 2015.
(Continued)

*Primary Examiner* — Taras P Bemko
(74) *Attorney, Agent, or Firm* — Jones Walker LLP

(57) ABSTRACT

An apparatus including a rotating segment having a first radial surface, a non-rotating segment having a second radial surface, a housing disposed around the first and second radial surfaces, and one or more rolling elements disposed between and in contact with the first and second radial surfaces for transferring the non-rotating segment in an axial direction upon rotation of the rotating segment. The non-rotating element may be a second rotating element that rotates at a different rotational rate than the rotating element. Each rolling element moves 360 degrees along a circular path relative to the first radial surface and the second radial surface. The first or second radial surface has a tapered section. A downhole apparatus includes a power mandrel having a first end connected to a power section member and a second end having a rotating cam surface; a rotating element engaging the rotating cam surface; an anvil sub attached to a workstring, with the anvil sub having a stationary cam surface configured to engage with the rotat-
(Continued)

ing cam surface. Rotation of the rotating cam surface moves the anvil sub and the workstring axially within the wellbore.

16 Claims, 12 Drawing Sheets

Related U.S. Application Data

(60) Provisional application No. 62/065,182, filed on Oct. 17, 2014.

(51) Int. Cl.
*E21B 3/00* (2006.01)
*E21B 17/07* (2006.01)

(58) Field of Classification Search
USPC ..... 175/57
See application file for complete search history.

(56) References Cited

U.S. PATENT DOCUMENTS

| | | | |
|---|---|---|---|
| 3,443,446 | A | 5/1969 | Buergel |
| 4,509,379 | A | 7/1985 | Westmorland |
| 4,718,291 | A | 1/1988 | Wood et al. |
| 4,890,682 | A | 1/1990 | Worrall et al. |
| 2011/0031020 | A1 | 2/2011 | Cote |

OTHER PUBLICATIONS

Counterpart International (PCT) Application No. PCT/US2015/53418.

International Search Report and Written Opinion from counterpart International (PCT) Application No. PCT/US2015/53418.

UP DRILL APPARATUS AND METHOD

CROSS-REFERENCE TO RELATED APPLICATIONS

This application is a continuation of and claims priority to U.S. patent application Ser. No. 14/863,760, filed on Sep. 24, 2015, which claims priority to U.S. Provisional Patent Application No. 62/065,182, filed on Oct. 17, 2014, each of which is incorporated herein by reference.

BACKGROUND

In one aspect, one disclosed embodiment relates to an apparatus having two tapered circumferential areas rotating against each other with at least one rolling element placed between the tapered circumferential areas.

In another aspect, a downhole tool embodiment is disclosed. More particularly, but not by way of limitation, this embodiment relates to a downhole tool used in drilling wellbores. The downhole tool may be used with a drilling motor and bit, and wherein the wellbore may include a straight hole, deviated hole, or horizontal hole.

SUMMARY OF THE INVENTION

In one embodiment, an apparatus is disclosed that includes a rotating segment having a first radial surface with a first circumferential profile; a non-rotating segment having a second radial surface with a second circumferential profile; a housing disposed around the first and second radial surfaces; and one or more rolling elements disposed between and in contact with the first and second radial surfaces for transferring the non-rotating segment in an axial direction upon rotation of the rotating segment. Each rolling element moves 360 degrees along a circular path relative to the first radial surface and 360 degrees along a circular path relative to the second radial surface. The rotating segment rotates more than 360 degrees relative to the non-rotating segment. The first circumferential profile may include the tapered section, which may include an undulating waveform profile. The second circumferential profile may include the tapered section, which may include an undulating waveform profile. Each of the rolling elements may include a spherical outer surface. In one embodiment, the apparatus may include two rolling elements in contact with one another, and with each rolling element having a diameter that is equal to one-half of an inner diameter of the housing. In another embodiment, the apparatus may include three or more rolling elements, with each rolling element in contact with two adjacent rolling elements. In yet another embodiment, the apparatus may include two or more rolling elements and a guide member, which is disposed between the first and second radial surfaces for retaining the rolling elements in a fixed position relative to one another.

In another embodiment, an apparatus is disclosed that includes a first rotating segment having a first radial surface with a first circumferential profile; a second rotating segment having a second radial surface with a second circumferential profile; a housing disposed around the first and second radial surfaces; and one or more rolling elements disposed between and in contact with the first and second radial surfaces for transferring the second rotating segment in an axial direction upon rotation of the first rotating segment. The second rotating segment rotates at different rotational rate than the first rotating segment. Alternatively, first and second rotating segments rotate in opposite directions. Each rolling element moves 360 degrees along a circular path relative to the first radial surface and 360 degrees along a circular path relative to the second radial surface. The first rotating segment rotates more than 360 degrees relative to the second rotating segment. The first circumferential profile may include the tapered section, which may include an undulating waveform profile. The second circumferential profile may include the tapered section, which may include an undulating waveform profile. Each of the rolling elements may include a spherical outer surface. In one embodiment, the apparatus may include two rolling elements in contact with one another, and with each rolling element having a diameter that is equal to one-half of an inner diameter of the housing. In another embodiment, the apparatus may include three or more rolling elements, with each rolling element in contact with two adjacent rolling elements. In yet another embodiment, the apparatus may include two or more rolling elements and a guide member, which is disposed between the first and second radial surfaces for retaining the rolling elements in a fixed position relative to one another.

In another embodiment, a downhole apparatus connected to a workstring within a wellbore is disclosed. The downhole apparatus includes a power mandrel having a first end operatively connected to a power section member and a second end having a rotating cam surface, with the power mandrel being disposed within an outer housing. The downhole apparatus also includes an anvil sub operatively attached to the workstring, with the anvil sub having a stationary cam surface operatively configured to engage the rotating cam surface. As the rotating cam surface engages the stationary cam surface, the anvil sub and the workstring are moved axially within the wellbore. The downhole apparatus may also include a first spline member configured on an outer surface of the anvil sub and a second spline member configured on the inner surface of the outer housing, with the first and second spline members cooperating to allow relative axial movement between the anvil sub and the outer housing. The power mandrel may be partially disposed within the outer housing. The apparatus may also include a biasing member operatively disposed about the anvil sub, with the biasing member having a first end engaging a shoulder on the anvil sub and a second end engaging a shoulder on the outer housing for biasing the anvil sub away from the shoulder of the outer housing. The downhole apparatus may include a radial bearing positioned on the inner surface of the outer housing and operatively configured to engage the power mandrel, and a thrust bearing configured to engage a shoulder on the power mandrel and a shoulder on the inner surface of the outer housing. In one embodiment, the rotating cam surface includes a radial face having an inclined portion and an upstanding portion and the stationary cam surface includes a radial face having a reciprocal inclined portion and a reciprocal upstanding portion. In another embodiment, the rotating and stationary cam surfaces may each include an undulating radial face. In still another embodiment, the rotating and stationary cam surfaces may each include a tapered circumferential profile. In yet another embodiment, the rotating and stationary cam surfaces may each include an undulating, multiple segmented radial face. The downhole apparatus may include one or more rolling elements disposed between and in contact with the rotating cam surface and the stationary cam surface. The rolling element may include a spherical outer surface. In one embodiment, the downhole apparatus includes two rolling elements in contact with one another, each having a diameter that is equal to one-half of an inner diameter of the housing. In another embodiment, the downhole apparatus includes three or more rolling elements, with each of the rolling elements in contact with two adjacent rolling elements. In a further embodiment, the downhole apparatus includes two or more rolling elements and a guide member disposed between the rotating cam surface and the stationary cam surface for retaining the rolling elements in a fixed position relative to one another. The power section member may include a rotor-stator unit. The rotor-stator unit may be part of a downhole motor.

Also disclosed is a method of drilling a wellbore with a downhole apparatus. The downhole apparatus is connected to a workstring within the wellbore, and the apparatus includes: a power mandrel having a first end operatively connected to a power section member and a second end having a rotating cam surface; an anvil sub operatively attached to the workstring, with the anvil sub having a stationary cam surface operatively configured to engage with the rotating cam surface. The method may include providing the apparatus on the workstring, lowering the downhole apparatus and the workstring into the wellbore, pumping fluid into the workstring, rotating the power mandrel while maintaining the anvil sub in a stationary position, and engaging the stationary cam surface with the rotating cam surface so that the anvil sub and the workstring are moved axially within the wellbore relative to the power mandrel. The rotating cam surface may include a radial face having an inclined portion and an upstanding portion, and the stationary cam surface may include a radial face having a reciprocal inclined portion and a reciprocal upstanding portion. In one embodiment, the rotating and stationary cam surfaces may each include an undulating radial face. In another embodiment, the rotating and stationary cam surfaces may each include a tapered circumferential area. The downhole apparatus may further include one or more rolling elements disposed between and in contact with the stationary cam surface and the rotating cam surface.

In yet another embodiment, an apparatus connected to a workstring within a wellbore. The apparatus includes: an outer housing; a power mandrel having a first end operatively connected to a power section member and a second end having a rotating cam surface, with the power mandrel being disposed within the outer housing; a rotating element engaging the rotating cam surface; an anvil sub operatively attached to the workstring, with the anvil sub having a stationary cam surface operatively configured to engage with the rotating element. As the rotating cam surface rotates and engages the rotating element, the anvil sub and the workstring are moved axially within the wellbore. The apparatus may also include a first spline member configured on an outer surface of the anvil sub and a second spline member configure on the inner surface of the outer housing, with the first and second spline members cooperating to allow relative axial movement between the anvil sub and the outer housing. The apparatus may further include: a spring operatively disposed about the anvil sub, with the spring having a first end engaging a shoulder on the anvil sub and a second end engaging a shoulder on the outer housing, wherein the spring biases the anvil sub and the outer housing in opposite axial directions. The apparatus may also include a radial bearing positioned on the inner surface of the outer housing and operatively configured to engage the power mandrel, and a thrust bearing configured to engage a shoulder on the power mandrel and a shoulder on the inner surface of the outer housing. The rotating cam surface may include a radial face having an inclined portion and an upstanding portion and the stationary cam surface may include a radial face having a reciprocal inclined portion and a reciprocal upstanding portion. In one embodiment, the rotating and stationary cam surfaces may each include an undulating radial face. In another embodiment, the rotating and stationary cams may each include a tapered circumferential.

DETAILED DESCRIPTION OF THE PREFERRED EMBODIMENTS

Figure 1:
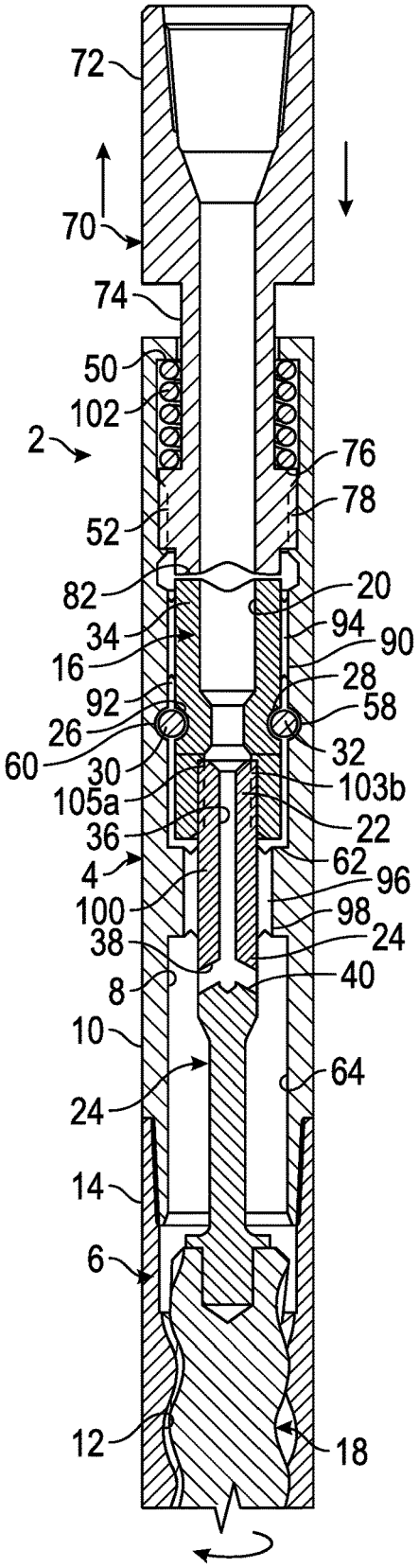
FIG. 1 is a partial cross-sectional view of a one embodiment of the up-drill apparatus of the present disclosure.

Referring now to FIG. 1, a partial cross-sectional view of one embodiment of the up-drill apparatus 2 of the present disclosure will now be described. The apparatus 2 includes an outer housing, wherein the outer housing may include a first housing 4 that is threadedly connected to a second housing 6, wherein the first housing 4 has an inner portion 8 that extends to the outer portion 10 and the second housing 6 has an inner portion 12 that extends to the outer portion 14.

The housings 4 and 6 will have disposed therein an upper power mandrel, seen generally at 16, which extends to a power section member, such as rotor-stator unit 18. The rotor-stator unit 18 may be part of a downhole motor means for drilling a well. Downhole motors are well known in the art and are commercially available from Ashmin, LC. Alternatively, apparatus 2 may be a stand-alone unit with a rotor-stator unit 18 separate from any downhole motor. As seen in FIG. 1, the upper power mandrel 16 includes an inner bore 20 that extends to a spline member 22, wherein the spline member 22 is configured to engage an intermediate power mandrel 24.

The outer surface of upper power mandrel 16 contains indentations 26, 28 for placement of axial thrust bearings 30, 32, respectively, for absorbing axial thrust loads during rotational operations as well understood by those of ordinary skill in the art. The upper power mandrel 16 also contains rotating cam surface, seen generally at 34, which will be described later in the disclosure. The intermediate power mandrel 24 has an inner bore 36, wherein the inner bore 36 extends to channels 38, 40 for channeling of the drilling fluid through the apparatus 2. The intermediate power mandrel 24 has on one end an outer thread means that will threadedly engage with the rotor-stator unit 18. As understood by those of ordinary skill in the art, a lower power mandrel (not seen in this view) is included, and wherein the lower power mandrel is connected to the bit member so that the well can be drilled.

The inner portion 8 of the first housing 4 contains an upper radial shoulder 50 which in turn extends to inner splines 52. The inner portion 8 also contains indentations 58, 60, which cooperate and engage with the axial thrust bearings 30, 32. The inner portion 8 also extends to the radial shoulder 62 which in turn extends to the enlarged diameter bore 8.

The apparatus 2 also includes the anvil sub seen generally at 70. The anvil sub 70 has an outer diameter surface 72 that extends to a second outer diameter surface 74, which in turn extends to the radial shoulder 76, wherein the radial shoulder 76 then extends to a splined surface 78 that will engage with inner splines 52 of the first housing 4. The anvil sub 70 terminates at the stationary cam surface 82, wherein the stationary cam surface 82 will cooperate and engage rotating cam surface 34.

In the embodiment of FIG. 1, the apparatus 2 includes the radial bearing 90 for distributing radial loads during operation, wherein the radial bearing 90 is disposed between the inner bore 92 of the first housing 4 and the outer surface 94 of the upper power mandrel 16. Another radial bearing 96 for distributing radial loads during operation is provided, and wherein the radial bearing 96 is disposed between the inner surface 98 and the outer surface 100 of the intermediate power mandrel 24.

FIG. 1 also depicts the biasing member 102, which may also be referred to as return spring 102 or spring 102. The biasing member 102 will act against the radial shoulder 50 on one end and against the radial shoulder 76 on the other end. In operation, as the intermediate power mandrel 24 is turned by the downhole motor (motor not seen in this view), the upper power mandrel 16 is turned via the splines 103*a* of the intermediate power mandrel 24 engaging splines 103*b* located on upper power mandrel 16. The rotating cam surface 34 is rotating thereby engaging the stationary cam surface 82, wherein the cooperating cam surfaces 34, 82 cause the anvil sub 70 to move axially in a first direction and then in a second direction. The biasing member 102 acts to bias the anvil sub 70 into axial movement in the second direction after its axial movement in the first direction. In this way, any friction encountered by the workstring will be diminished by the axial movement of the downhole apparatus 2.

Figure 2:
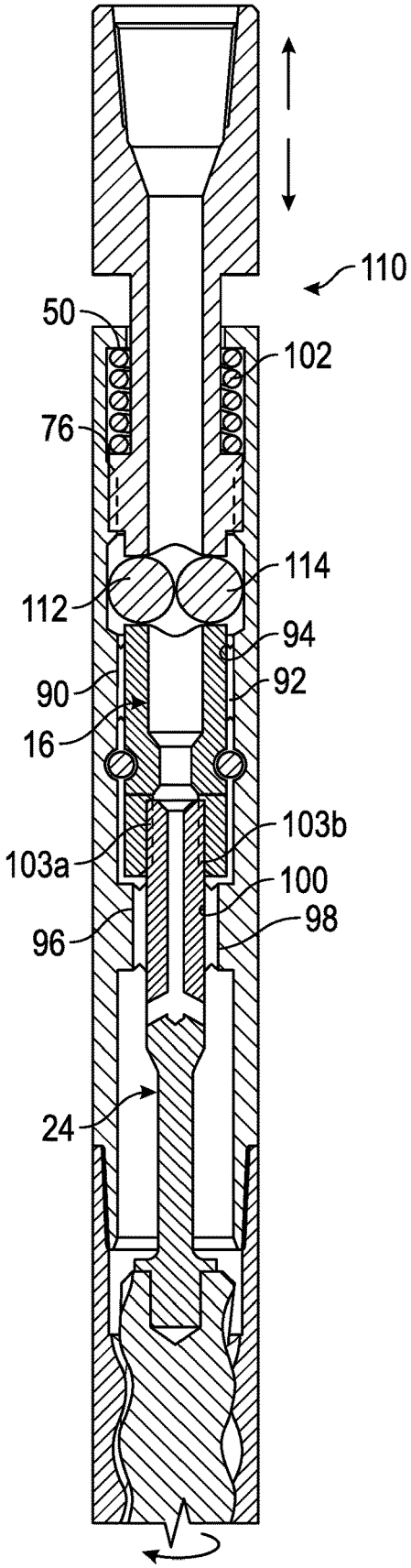
FIG. 2 is a partial cross-sectional view of another embodiment of the up-drill apparatus of the present disclosure.

Referring now to FIG. 2, a partial cross-sectional view of another embodiment of the up-drill apparatus 2 of the present disclosure will now be described. It should be noted that like numbers appearing in the various figures refer to like components. The apparatus 2 of FIG. 1 is similar to the apparatus 110 of FIG. 2 and some of the similarities will not be repeated. FIG. 2 further contains the rolling elements 112, 114 interfaced between the stationary cam surface 82 and the rotating cam surface 34. Rolling elements 112, 114 may be referred to as rotating elements. In one preferred embodiment, rolling elements 112, 114 may be spherical members such as stainless steel ball bearings or ceramic balls. A feature of this disclosure is that use of the rolling elements 112, 114 allows for less of a direct impact on the stationary cam surface 82 and the rotating cam surface 34 when the surfaces 82 and 34 are interacting, which thereby produces less friction, abrasive wear, stress, and fatigue, which in turn increases the life of the surface 82 and surface 34.

Figure 3A:
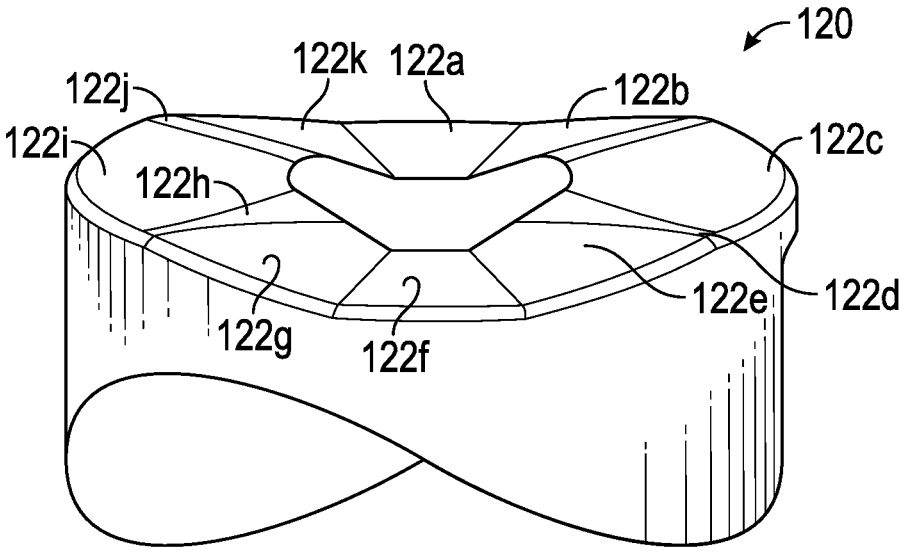
FIG. 3A is a view of a first embodiment of the cam surface of the present disclosure.
Figure 3B:
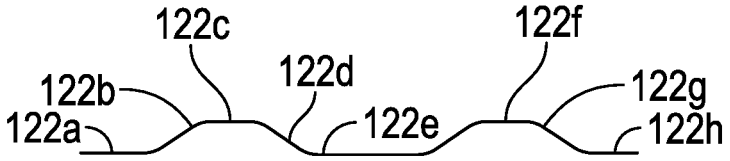
FIG. 3B is a view of the cam surface profile seen in FIG. 3A.

Referring now to FIG. 3A, an illustration of a first embodiment of the cam surface 120 of the present disclosure will now be described. It should be noted that the cam surfaces of FIGS. 3A-3D may be either the rotating cam surface or the stationary cam surfaces since the two cam surfaces are reciprocating and mating. In FIG. 3A, the cam surface 120 contains a series of surfaces, namely surface 122*a*, 122*b*, 122*c*, 122*d*, 122*e*, 122*f*, 122*g*, 122*h*, 122*i*, 122*j*, 122*k*, wherein each surface has a rising or falling slope. The cam surface 120 has an undulating, mulitple segmented radial face. FIG. 3B is a circumferential profile view of the cam surface profile 120 seen in FIG. 3A, and for instance surfaces 122*a*, 122*b*, 122*c*, 122*d*, 122*e*, 122*f*, 122*g*, and 122*h* are shown. The cam surface 120 will engage a reciprocal cam surface (not shown here) during operation.

Figure 3C:
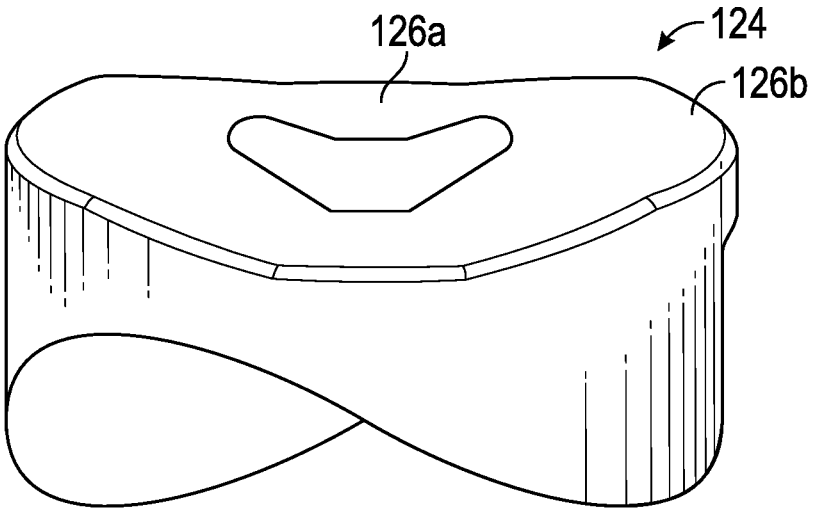
FIG. 3C is a view of a second embodiment of the cam surface of the present disclosure.

FIG. 3C is a view of a second embodiment of the cam surface 124 of the present disclosure. This embodiment shows a cam low side 126*a* and a cam high side 126*b*. The profile for this cam surface 124 is a smoother wave form. In one embodiment, surface 124 may be a sinusoidal waveform. It should be noted that both cam surfaces 120 and 124 may be referred to as an undulating profile. The cam surface 124 will engage a reciprocal cam surface (not shown here) during operation.

Figure 3D:
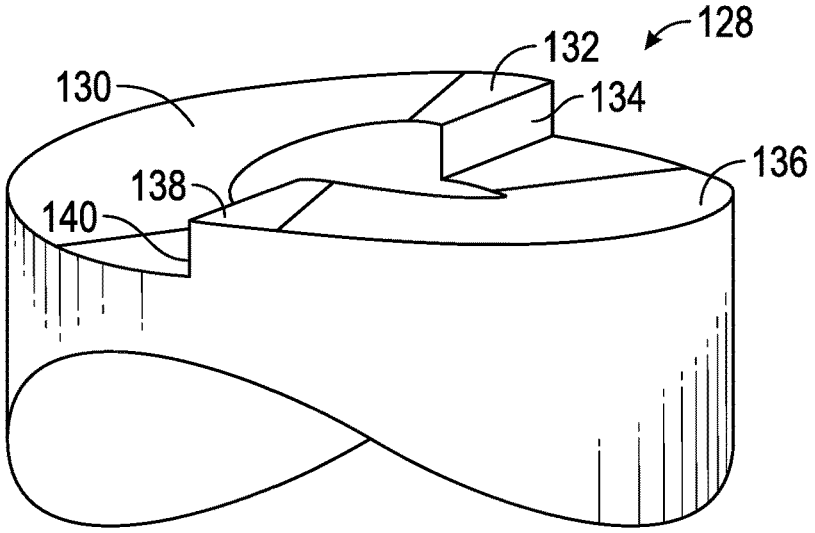
FIG. 3D is a view of a third embodiment of the cam surface of the present disclosure.

Referring now to FIG. 3D, an illustration of a third embodiment of the cam surface 128 of the present disclosure will now be described. The cam surface 128 includes a ramp 130 (i.e. rising slope) that extends to a top end 132 (i.e. radially flat portion), which in turn extends to the upstanding portion 134. The cam surface 128 may have two or more ramps; hence, there is also provided a ramp 136 that extends to a top end 138, which in turn extends to the upstanding portion 140. The cam surface 128 will engage a reciprocal cam surface (not shown here) during operation.

Figure 4:
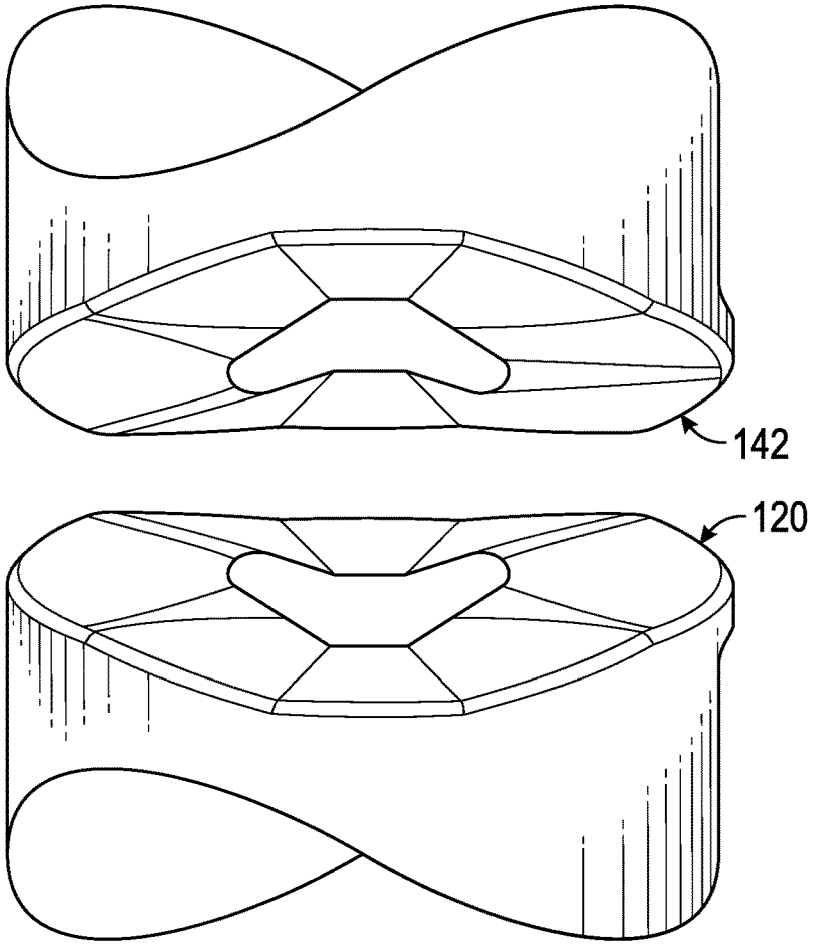
FIG. 4 is a view of one embodiment of reciprocal of cams

FIG. 4 is a view of one embodiment of reciprocal cams; more specifically, FIG. 4 depicts the cam surface 120, which in this embodiment is the rotating cam surface 120. The reciprocal, stationary (i.e. non-rotating) cam surface 142 is shown, and wherein the stationary cam surface 142 is reciprocal and configured to cooperate with and engage with the rotating cam surface 120.

Figure 5:
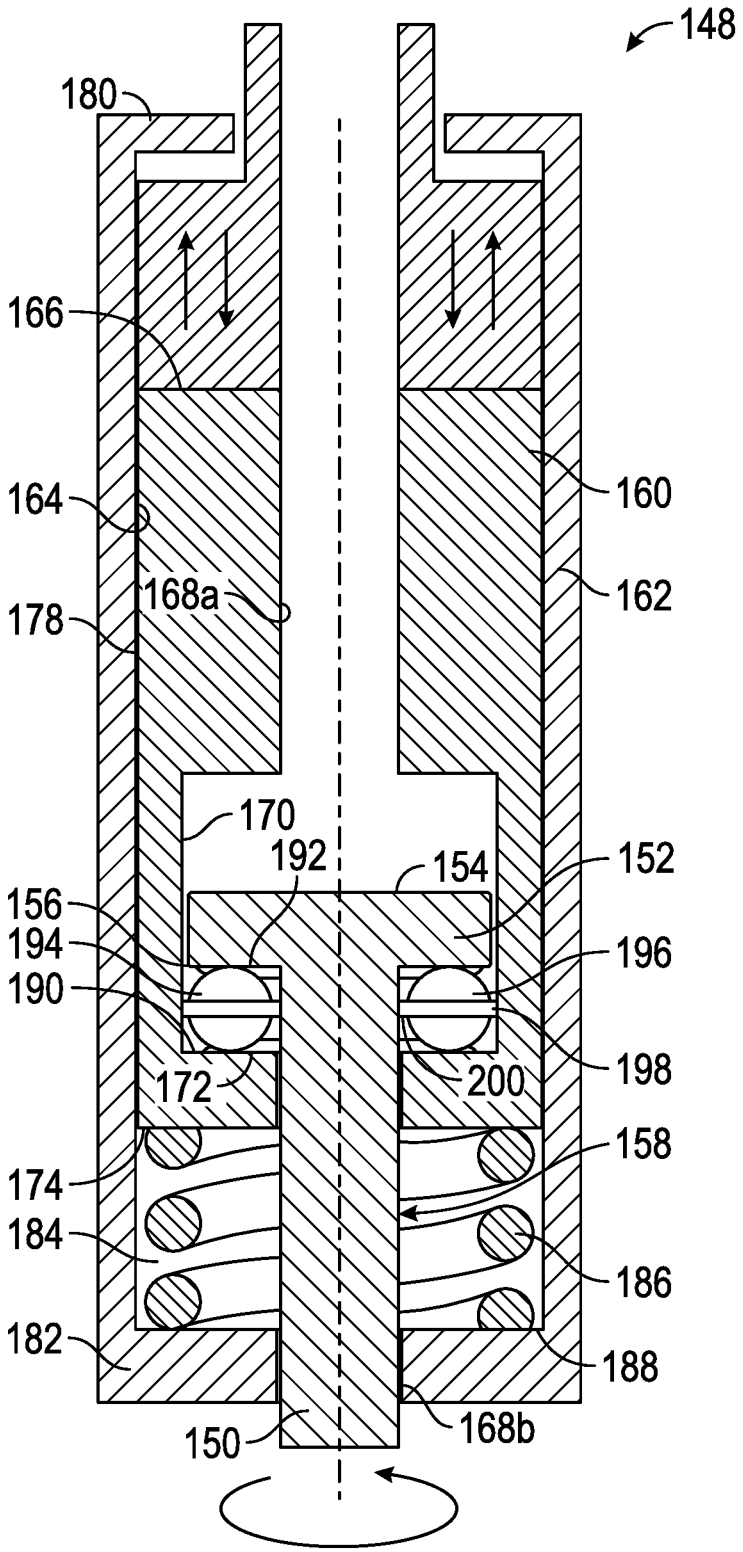
FIG. 5 is a partial cross-sectional view of another embodiment of the up-drill apparatus of the present disclosure.

Referring now to FIG. 5, a partial cross-sectional view of yet another embodiment of an up-drill apparatus 148 of the present disclosure will now be described. FIG. 5 depicts the power mandrel 150 that will be operatively associated with a power section member, such as a rotor-stator means. The power mandrel 150 has an upper end 152 that may also be referred to as a "T-end". The T-end has an upper surface 154 and a lower surface 156, wherein the lower surface 156 is also referred to as the rotating cam surface 156. The upper end 152 extends to the shaft portion seen generally at 158, which in turn extends to the power section member (not shown here). FIG. 5 also depicts the sub, seen generally at 160, wherein the sub 160 is disposed within a housing 162. The sub 160 has an outer surface 164 that has at one end the radial surface 166, with the sub 160 having a bore 168*a* that extends to an expanded bore area 170, which in turn extends to the internal radial surface end 172. The sub 160 has at the second end the radial surface 174.

As seen in FIG. 5, the sub 160 is contained within the inner portion 178 of housing 162. The housing 162 is generally cylindrical and has a top portion 180 and a bottom portion 182. The shaft portion 158 is disposed through the bore extension 168*b*. As seen in FIG. 5, a cavity area 184 is formed between the radial surface 174 and the bottom portion 182 of the housing 162. A biasing member, such as coiled spring 186, wherein the biasing member 186 will act against the radial surface 174 and the internal surface 188 of the housing 162. The internal radial surface 172 contains a cam profile surface 190, such as stationary cam surface 82 as previously mentioned and seen in FIG. 1; and, lower surface 156 contains a rotating cam surface 192, such as rotating cam surface 34 and seen in FIG. 1. Rolling elements 194, 196 are also included, wherein the rolling elements 194, 196 may be spherical members, elongated spherical members, cylindrical members, other convex members, or concave members. In one embodiment, the spherical elements are stainless steel ball bearings or ceramic balls. FIG. 5 also depicts the guide member 198 which is configured to contain the spherical members 194, 196 in a fixed position relative to one another. Note that guide member 198 contains an opening 200, wherein opening 200 will have the shaft portion 158 disposed there through. Guide member 198 may also be referred to as cage or cage member.

Figure 6:
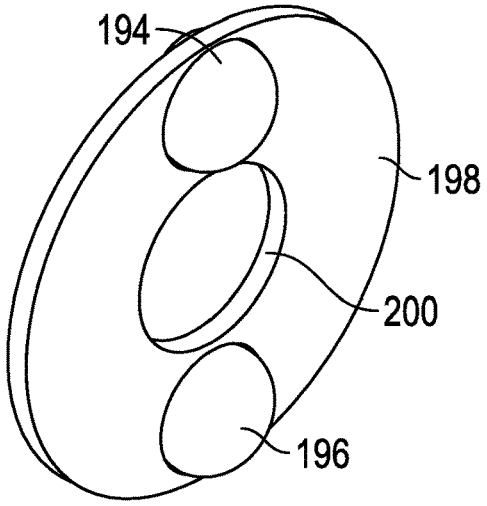
FIG. 6 is a perspective view of the rolling elements shown in FIG. 5 disposed within a guide member.

FIG. 6 is a perspective view of the cage 198 having disposed therein the spherical members 194, 196. Bore 200 used for placement of the shaft 158 is also shown. With the embodiment of FIG. 6, the spherical members 112, 114 are held in place during rotational operation of the cam surfaces.

Figure 7A:
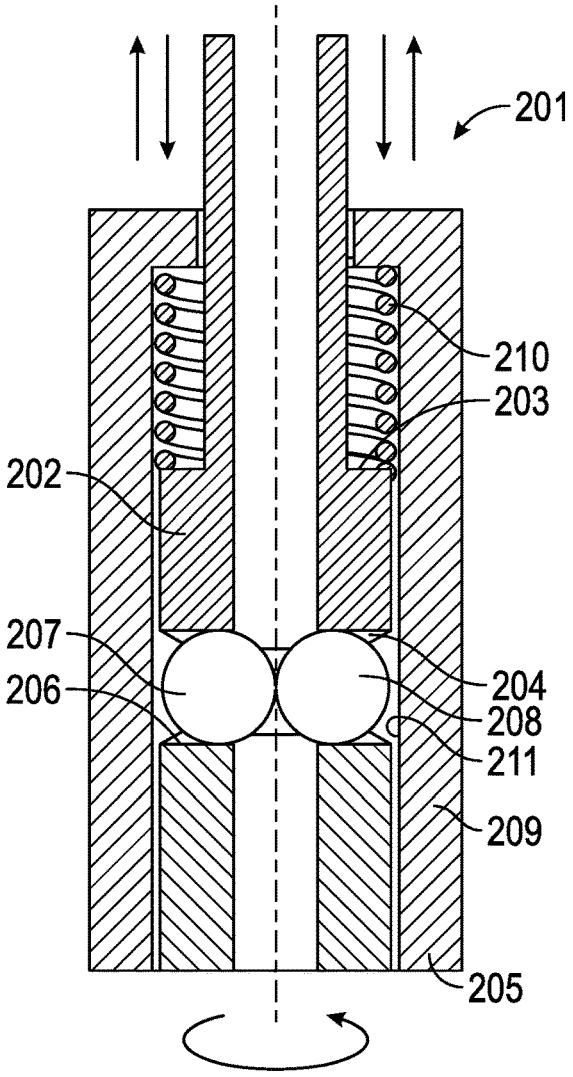
FIG. 7A is a partial cross-sectional view of another embodiment of the up-drill apparatus of the present disclosure.

FIG. 7A illustrates another up-drill apparatus 201 including sub 202 having radial shoulder 203 and radial cam surface 204. Apparatus 201 also includes power mandrel 205 having radial cam surface 206 designed to rotate. Rolling elements 207 and 208 are disposed between and in contact with radial cam surfaces 204 and 206. Sub 202 and power mandrel 205 are at least partially contained within housing 209 such that radial cam surfaces 204, 206 and rolling elements 207, 208 are contained within housing 209. Apparatus 201 may further include spring member 210 in contact with an upper shoulder of housing 209 and radial shoulder 203 such that spring member 201 biases housing 209 and sub 202 in opposite axial directions. In this embodiment having two rolling elements, rolling elements 207 and 208 may each be a spherical member having a diameter that is one-half of the inner diameter 211 of housing 209, such that the spherical members are in contact with one another. Rolling elements 207 and 208 may be free to move between radial cam surfaces 204 and 206 as power mandrel 205 rotates. Rolling elements 207 and 208 may move in a circular path on radial cam surface 206 as power mandrel 205 rotates. This movement of rolling elements 207 and 208 may cause sub 202 to move in the axial direction. Power mandrel 205 may rotate continuously such that it rotates more than 360 degrees relative to sub 202.

Figure 7B:
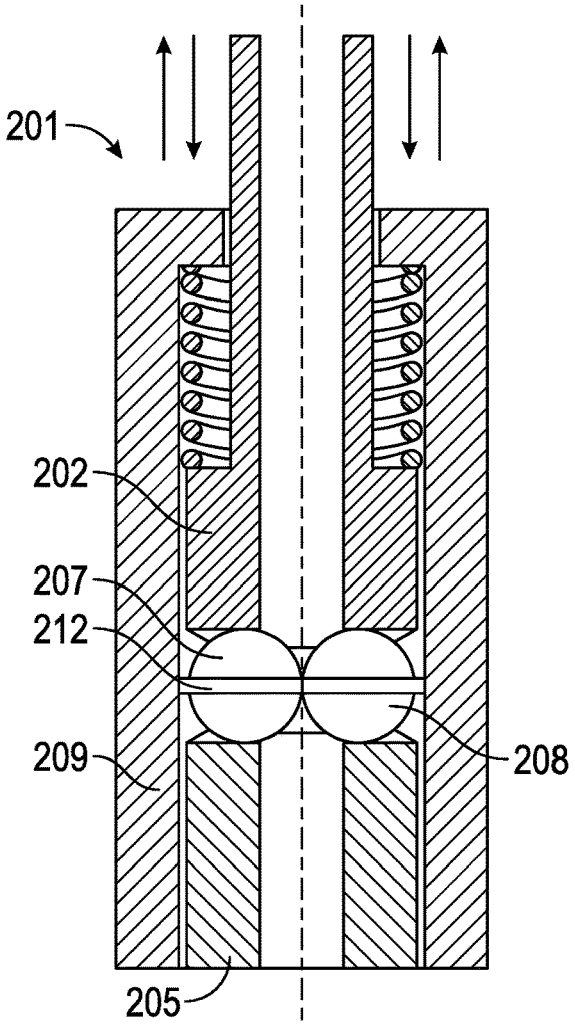
FIG. 7B is a partial cross-sectional view of the embodiment of the up-drill apparatus of the present disclosure shown in FIG. 7A with a guide member.

FIG. 7B illustrates apparatus 201 having guide member 212 disposed between radial cam surfaces 204 and 206 for retaining rolling elements 207 and 208 in a fixed position relative to one another.

Figure 8:
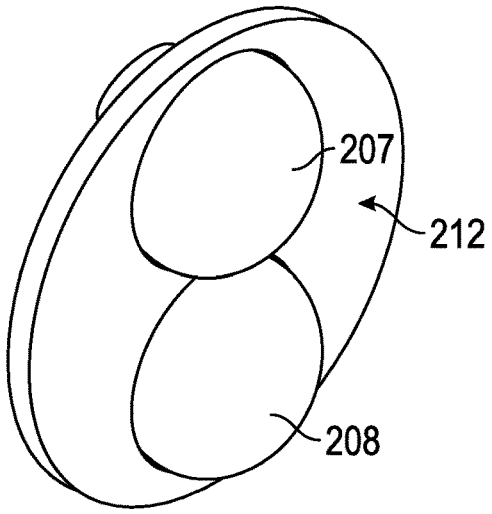
FIG. 8 is a perspective view of the rolling elements shown in FIG. 7B disposed within a guide member.

FIG. 8 shows guide member 212, or cage 212, with rolling elements 207 and 208. Guide member 212 is optional in apparatus 201 of FIGS. 7A and 7B where rolling element 207 and 208 are each a spherical member having a diameter that is one-half of the inner diameter of housing 209. However, a guide member, such as guide member 198 shown in FIG. 6, is preferred for apparatus 148 shown in FIG. 5 due to the smaller relative diameter of rolling elements 194 and 196 and due to the presence of shaft 158 between rolling elements 194 and 196. It should be understood that the downhole apparatus may include any number of rolling elements. Where three or more rolling elements are included, each rolling element may be in contact with two adjacent rolling elements. Alternatively, where rolling elements are not in contact with two adjacent rolling elements, a guide member may be used to retain each rolling element in a fixed position relative to the other rolling elements. The number of rolling elements included in the downhole apparatus may be equal to the number of high points or ramps on each of radial cam surfaces 204 and 206. Each of the rolling elements of the downhole apparatus may be the same size.

Figure 9:
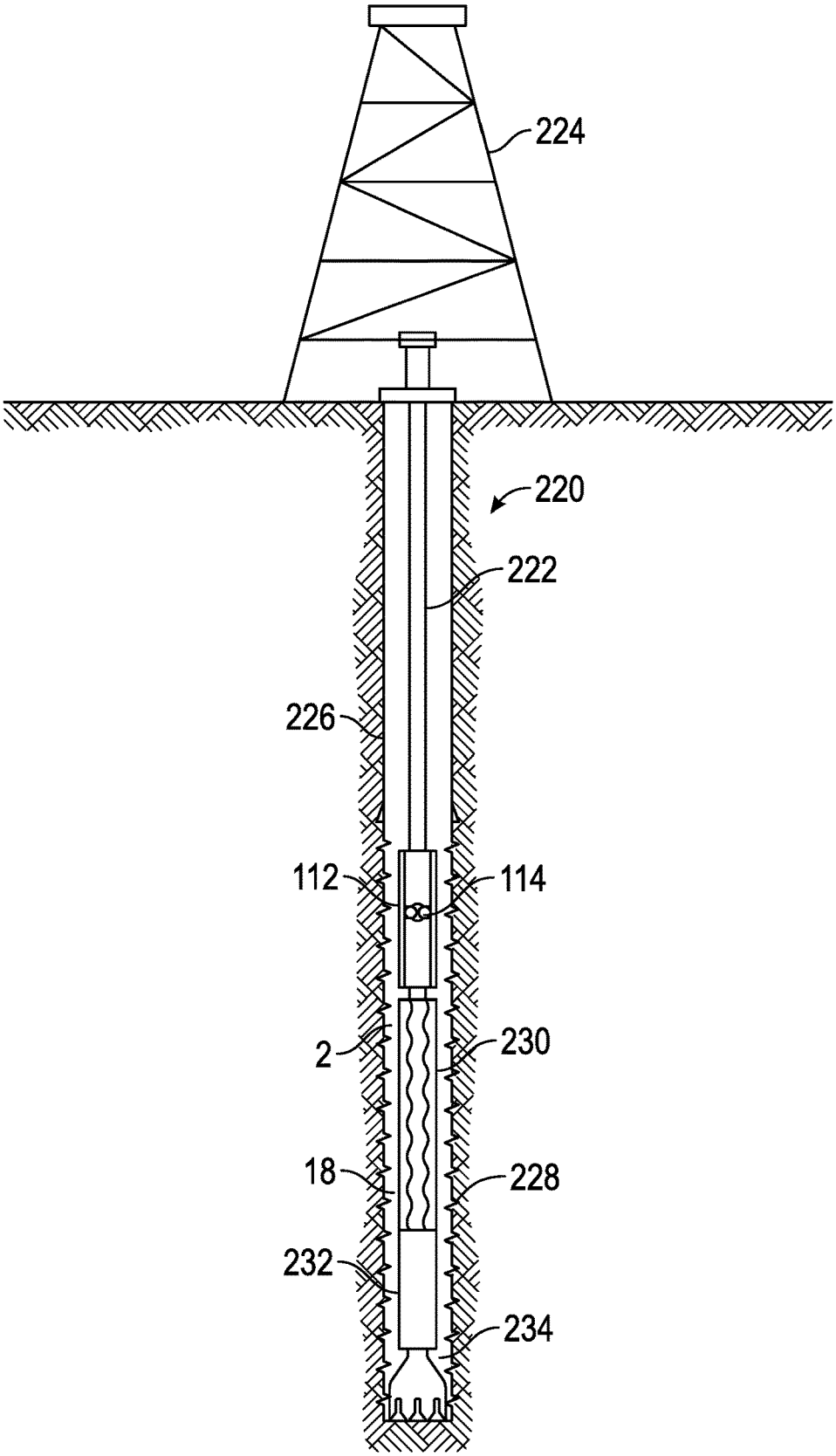
FIG. 9 is a schematic illustration of the up drill apparatus disposed within a wellbore.

Referring now to FIG. 9, a schematic illustration of the apparatus 2, as depicted in FIGS. 1 and 2, wherein the apparatus 2 is disposed within a wellbore 220 will now be described. A workstring 222 is disposed within the wellbore 220, wherein the workstring 222 is suspended from a rig 224. The workstring 222 may be a tubular drill string or a coiled tubing string, and wherein this list is meant to be exemplary. The wellbore 220 includes the casing string 226 with the bore hole 228 extending therefrom. FIG. 9 depicts the apparatus 2 being connected to a mud motor 230, wherein the mud motor 230 is commercially available from Ashmin, LC. The mud motor 230 has the rotor-stator 18 unit previously mentioned, and wherein the lower rotating power mandrel 232, operatively connected to the motor 230, will ultimately turn the bit 234 via the circulation of the drilling fluid, as well understood by those of ordinary skill in the art. The bit 234 ultimately drills the bore hole 228. Alternatively, apparatus 2 may include a power section member, such as a rotor-stator unit, separate from mud motor 230. The workstring 222 may be stationary (i.e. non-rotating) or rotating during the drilling operation.

The embodiment of FIG. 9 depicts the rolling elements 112, 114. Hence, during operation, the cam surfaces (not shown here) will engage and cooperate thereby axially moving the workstring 222 relative to the mud motor 230 and bit 234 thereby preventing sticking of the workstring 222 which will in turn provide for a more efficient drilling of the wellbore 220.

Figure 10:
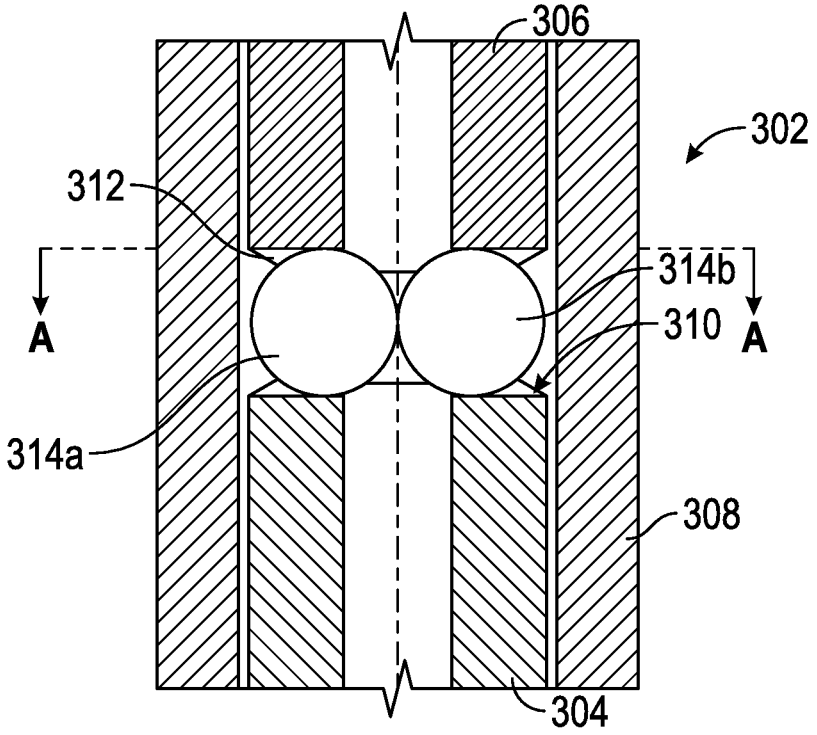
FIG. 10 is a cross-sectional view of an apparatus for applying axial movement with a rotating member.

FIG. 10 illustrates apparatus 302 including rotating member 304 (sometimes referred to as rotating segment) and second member 306 (sometimes referred to as second segment). Rotating member 304 and second member 306 may each be at least partially disposed within housing 308. Rotating member 304 may include first radial surface 310. Second member 306 may include second radial surface 312 opposing first radial surface 310. First radial surface 310 or second radial surface 312 may include a tapered surface as described above. In one embodiment, both radial surfaces 310, 312 include a tapered surface. The tapered surface may be an undulating waveform profile.

Apparatus 302 may include one or more rolling elements 314. In one embodiment, apparatus 302 includes two rolling elements 314*a*, 314*b* as shown in FIG. 10. Each rolling element may have, but is not limited to, a spherical outer surface having a diameter that is approximately equal to one-half of an inner diameter of housing 308 such that rolling elements 314*a* and 314*b* are in constant contact with one another. It should be understood that apparatus 302 may include any number of rolling elements. The number of rolling elements included in the downhole apparatus may be equal to the number of high points or ramps on each of radial surfaces 310 and 312. Each of the rolling elements may be the same size.

Rotating member 304 may rotate continuously relative to second member 306, i.e., rotating member 304 may rotate more than 360 degrees relative to second member 306. In one embodiment, second member 306 is a non-rotating member. Non-rotating member means that the member is not designed to rotate and the member is substantially non-rotating relative to the rotating member. In another embodiment, second member 306 is a member rotating at a different rotation rate than rotating member 304. Rotation rate is the speed of rotation, which may be measured in units of rotations or revolutions per minute (RPM). In a further embodiment, second member 306 and rotating member 304 rotate in opposite directions. In all embodiments, as rotating member 304 rotates relative to second member 306, rolling elements 314 move between first and second radial surfaces 310 and 312 thereby producing an axial movement of second member 306 relative to rotating member 304. Rolling elements 314 may each move 360 degrees along a circular path relative to second radial surface 312. Rolling elements 314 may also each move 360 degrees along a circular path relative to first radial surface 310. The movement of rolling elements 314 on first and second radial surfaces 310 and 312 may occur simultaneously, such that rolling elements 314 move 360 degrees along a circular path relative to the first radial surface 310 and simultaneously move 360 degrees along a circular path relative to the second radial surface 312.

It should be understood that apparatus 302 is not limited to the directional and inclinational arrangement shown. In other words, apparatus 302 will function as long as first radial surface 310 opposes second radial surface 31 with one or more rolling elements disposed between. Apparatus 302 may be arranged in an inverted vertical position relative to the one shown in these drawings. Apparatus 302 may also be arranged in a horizontal position or any other inclinational position.

Figure 11A:
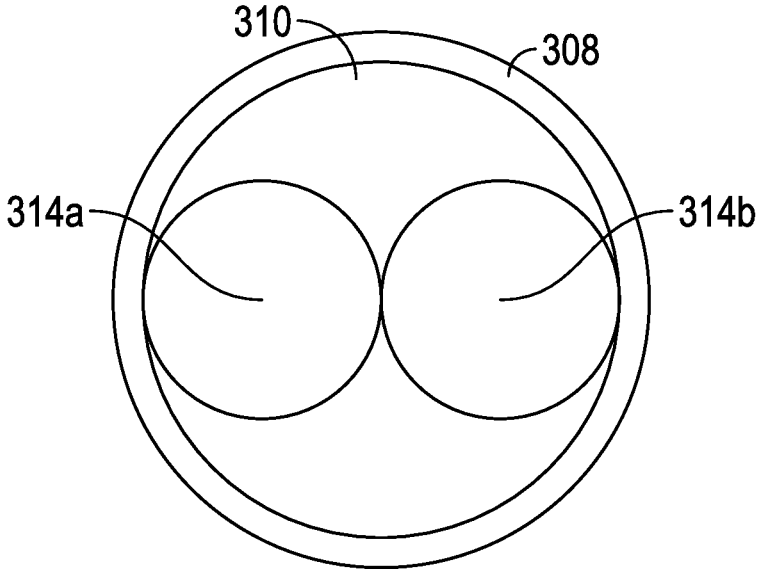
FIG. 11A is a cross-sectional view of the apparatus taken along line A-A in FIG. 10.

FIG. 11A is a cross-sectional view taken along line A-A in FIG. 10 showing rolling elements 314*a*, 314*b* on first radial surface 310 disposed within housing 308.

Figure 11B:
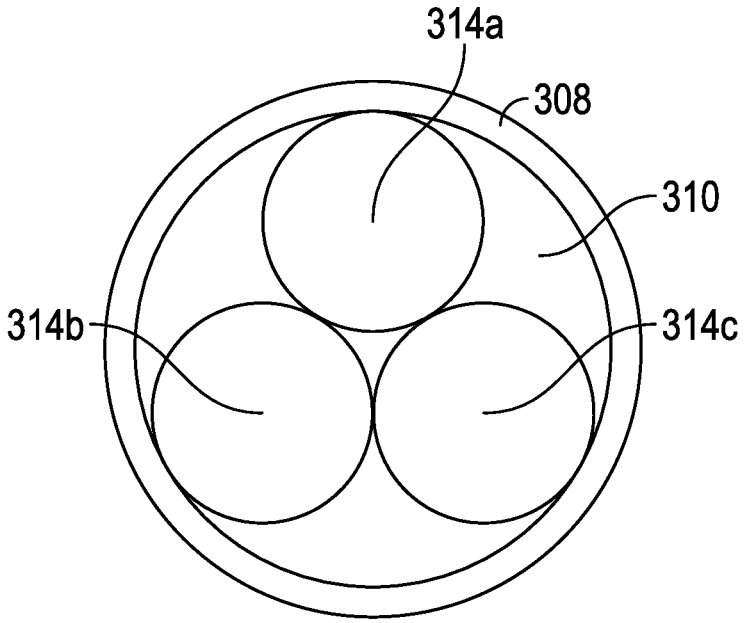
FIG. 11B is an alternate cross-sectional view of the apparatus taken along line A-A in FIG. 10.

FIG. 11B is an alternate cross-sectional view taken along line A-A in FIG. 10. In this embodiment, apparatus 302 includes three rolling elements, namely rolling elements 314*a*, 314*b*, 314*c*.

Figure 11C:
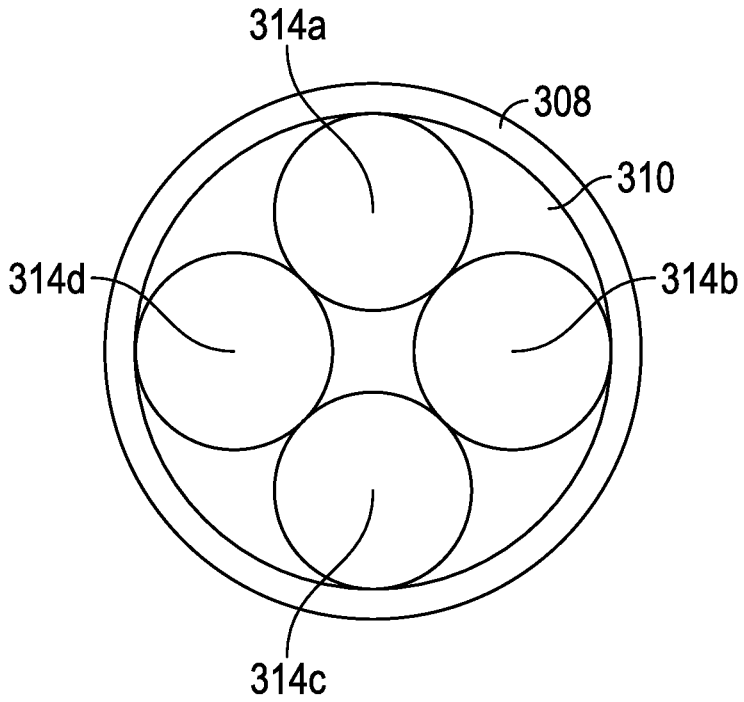
FIG. 11C is another alternate cross-sectional view of the apparatus taken along line A-A in FIG. 10.

FIG. 11C is another alternate cross-sectional view taken along line A-A in FIG. 10 showing apparatus 302 including four rolling elements, namely rolling elements 314*a*, 314*b*, 314*c*, 314*d*.

Figure 11D:
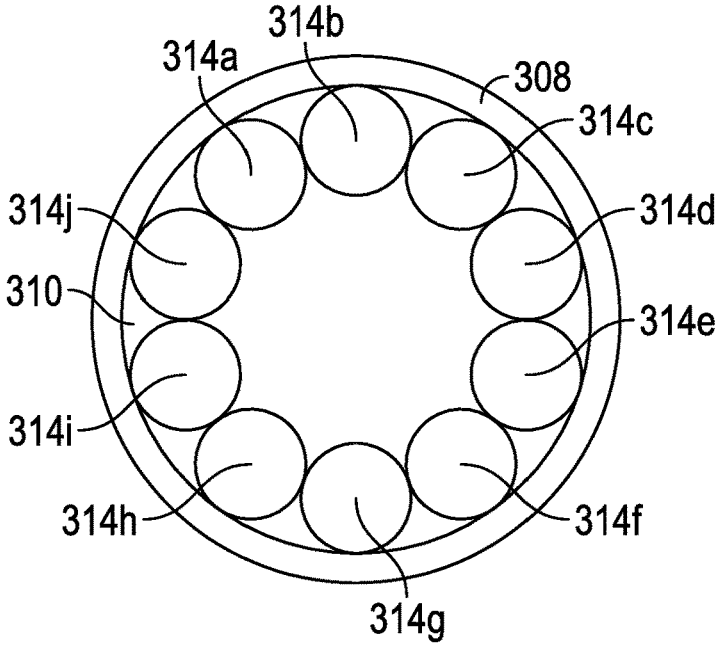
FIG. 11D is yet another alternate cross-sectional view of the apparatus taken along line A-A in FIG. 10.

FIG. 11D is yet another alternate cross-sectional view taken along line A-A in FIG. 10 showing apparatus 302 including ten rolling elements, namely rolling elements 314*a*, 314*b*, 314*c*, 314*d*, 314*e*, 314*f*, 314*g*, 314*h*, 314*i*, 314*j*.

Each rolling element in FIGS. 11B, 11C, and 11D may be dimensioned such that each rolling element is in contact with two adjacent rolling elements.

Figure 12:
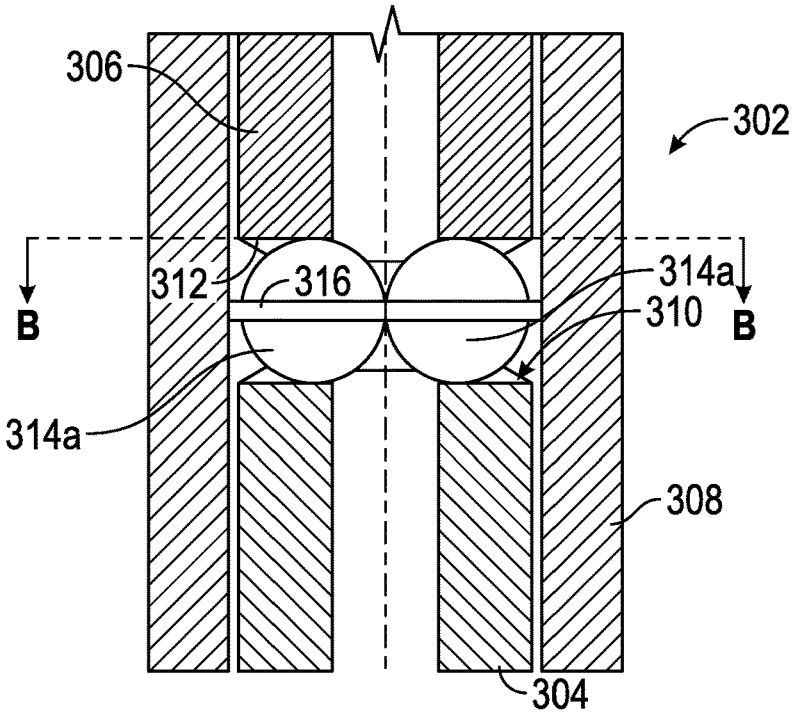
FIG. 12 is a cross-sectional view of the apparatus of FIG. 10 including a guide member.

FIG. 12 illustrates apparatus 302 having guide member 316 disposed between radial surfaces 310 and 312. Guide member 316 may be used to contain rolling elements 314*a* and 314*b* in a fixed position relative to one another.

Figure 13A:
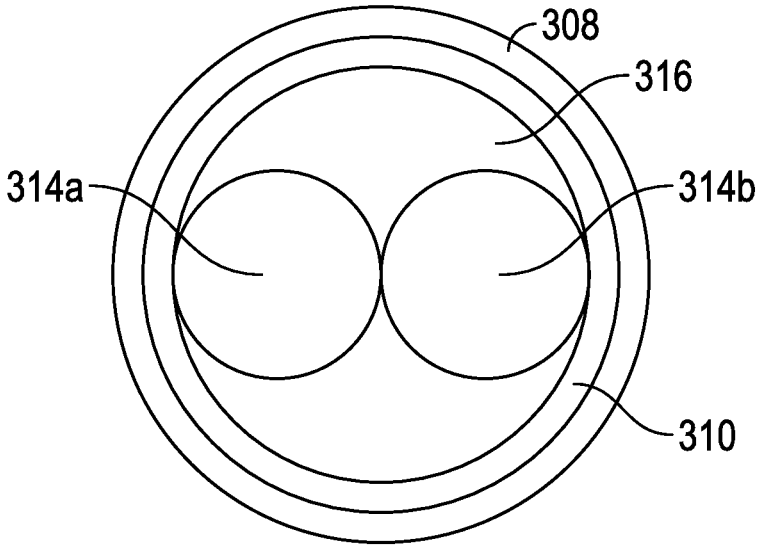
FIG. 13A is a cross-sectional view of the apparatus taken along line B-B in FIG. 12.

FIG. 13A is a cross-sectional view taken along line B-B in FIG. 12 showing rolling elements 314*a*, 314*b* retained by guide member 316 on first radial surface 310 disposed within housing 308. In this embodiment, rolling elements 314*a*, 314*b* are dimensioned so that they are in constant contact with one another.

Figure 13B:
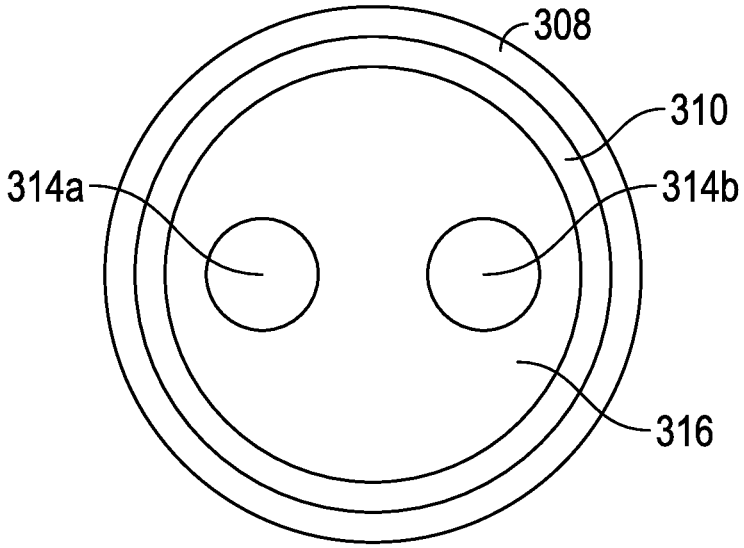
FIG. 13B is an alternate cross-sectional view of the apparatus taken along line B-B in FIG. 12.

FIG. 13B is an alternate cross-sectional view taken along line B-B in FIG. 12. In this embodiment, apparatus 302 includes two rolling elements 314*a*, 314*b*, with the rolling elements dimensioned so that they are separated from one another. Guide member 316 retains rolling elements 314*a*, 314*b* in a fixed position relative to one another, such as 180 degrees apart.

Figure 13C:
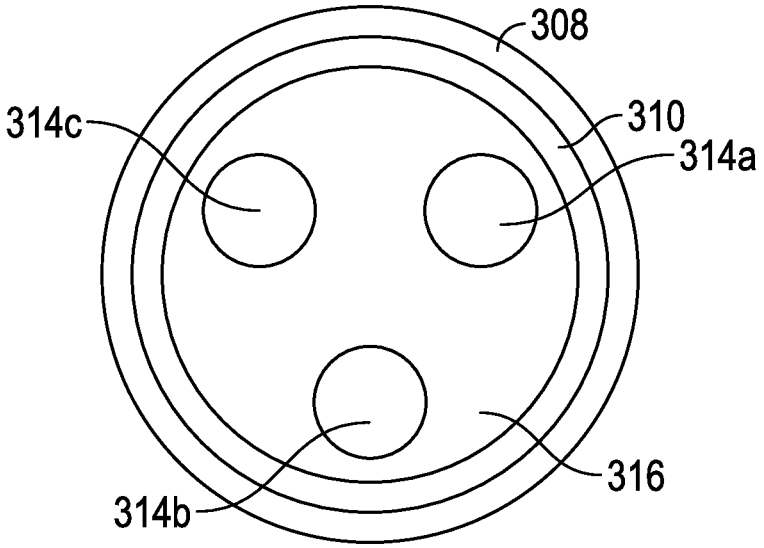
FIG. 13C is another alternate cross-sectional view of the apparatus taken along line B-B in FIG. 12.

FIG. 13C is another alternate cross-sectional view taken along line B-B in FIG. 12. In this embodiment, apparatus 302 includes three rolling elements 314*a*, 314*b*, 314*c*, with the rolling elements dimensioned so that they are separated from one another and retained in a fixed position relative to one another by guide member 316, such as 120 degrees apart.

Figure 13D:
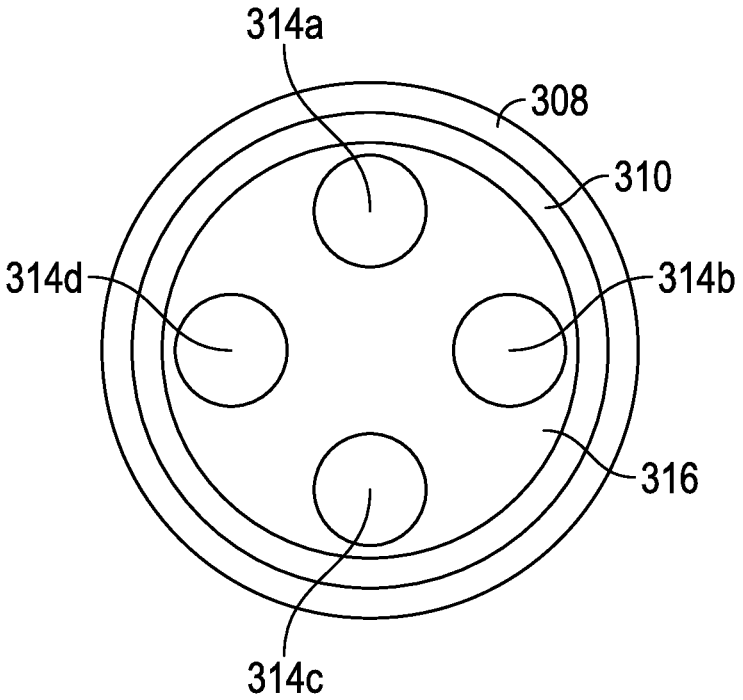
FIG. 13D is yet another alternate cross-sectional view of the apparatus taken along line B-B in FIG. 12.

FIG. 13D is yet another alternate cross-sectional view taken along line B-B in FIG. 12. In this embodiment, apparatus 302 includes four rolling elements 314*a*, 314*b*, 314*c*, 314*d*, with the rolling elements dimensioned so that they are separated from one another and retained in a fixed position relative to one another by guide member 316, such as 90 degrees apart.

It is to be understood that guide member 316 may be used with any number of rolling elements 314. Use of guide member 316 is preferred when rolling elements 314 are dimensioned so that each rolling element does not constantly contact two adjacent rolling elements, such as in the embodiments shown in FIGS. 13B, 13C, and 13D.

Apparatus 302 may be used in any number of tools, including downhole tools, in order to provide axial movement of a second member with the constant rotation of a rotating member.

Although the present invention has been described in considerable detail with reference to certain preferred versions thereof, other versions are possible. Therefore, the spirit and scope of the appended claims should not be limited to the description of the preferred versions contained herein.

What is claimed is:

1. A downhole apparatus connected to a workstring within a wellbore, the apparatus comprising:

a power mandrel having a first end operatively connected to a power section member and a second end having a rotating cam surface, said power mandrel being disposed within an outer housing above the power section member;

a sub operatively attached to the workstring, said sub having a stationary cam surface operatively configured to engage with said rotating cam surface;

wherein as said rotating cam surface engages said stationary cam surface, the sub and the workstring are moved axially within the wellbore relative to the outer housing;

wherein the power section member is operatively connected to a lower rotating power mandrel; and wherein the lower rotating power mandrel is operatively connected to a drill bit.

2. The downhole apparatus of claim 1, wherein said sub is an anvil sub.

3. The downhole apparatus of claim 2, further comprising:

a first spline member configured on an outer surface of said anvil sub;

a second spline member configured on an inner surface of said outer housing;

wherein said first and second spline members cooperate to allow relative axial movement between said anvil sub and said outer housing.

4. The downhole apparatus of claim 3, wherein the power mandrel is partially disposed within said outer housing, wherein the apparatus further comprises: a biasing member operatively disposed about said anvil sub, said biasing member having a first end engaging a shoulder on said anvil sub and a second end engaging a shoulder of said outer housing, wherein said biasing member biases said shoulder of said anvil sub away from said shoulder of said outer housing.

5. The downhole apparatus of claim 4, further comprising:

a radial bearing positioned on the inner surface of said outer housing and operatively configured to engage said power mandrel;

a thrust bearing configured to engage a shoulder on said power mandrel and a shoulder on said inner surface of said outer housing.

6. The downhole apparatus of claim 5, wherein said rotating cam surface comprises a radial face having an inclined portion and an upstanding portion and said stationary cam surface comprises a radial face having a reciprocal inclined portion and a reciprocal upstanding portion.

7. The downhole apparatus of claim 5, wherein said rotating and stationary cam surfaces each comprises an undulating radial face.

8. The downhole apparatus of claim 5, wherein said rotating and stationary cam surfaces each comprises a tapered circumferential profile.

9. The downhole apparatus of claim 5, wherein said rotating and stationary cam surfaces each comprises an undulating, multiple segmented radial face.

10. The downhole apparatus of claim 2, further comprising one or more rolling elements disposed between and in contact with said rotating cam surface and said stationary cam surface.

11. The downhole apparatus of claim 10, wherein each of said rolling elements includes a spherical outer surface.

12. The downhole apparatus of claim 10, wherein the one or more rolling elements comprises two rolling elements in contact with one another, and wherein a diameter of each of said rolling elements is approximately equal to one-half of an inner diameter of the housing.

13. The downhole apparatus of claim 10, wherein the one or more rolling elements comprises three or more rolling elements, wherein each of the rolling elements is in contact with two adjacent rolling elements.

14. The downhole apparatus of claim 10, wherein the one or more rolling elements comprises two or more rolling elements and a guide member, the guide member disposed between said rotating cam surface and said stationary cam surface for retaining said rolling elements in a fixed position relative to one another.

15. The downhole apparatus of claim 2, wherein said power section member includes a rotor-stator unit.

16. The downhole apparatus of claim 15, wherein the rotor-stator unit is part of a downhole motor.

* * * * *